US011168490B2

(12) United States Patent
Huang

(10) Patent No.: US 11,168,490 B2
(45) Date of Patent: Nov. 9, 2021

(54) FIXING STRUCTURE FOR LOCK, AND LOCK THEREWITH

(71) Applicant: TAIWAN FU HSING INDUSTRIAL CO., LTD., Kaohsiung (TW)

(72) Inventor: Lien-Hsi Huang, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 215 days.

(21) Appl. No.: 16/561,022

(22) Filed: Sep. 5, 2019

(65) Prior Publication Data

US 2020/0190850 A1 Jun. 18, 2020

(30) Foreign Application Priority Data

Dec. 12, 2018 (TW) ..... 107216876

(51) Int. Cl.
*E05B 9/08* (2006.01)
*E05B 15/00* (2006.01)
*E05B 17/00* (2006.01)

(52) U.S. Cl.
CPC ..... *E05B 9/082* (2013.01); *E05B 15/0033* (2013.01); *E05B 17/0004* (2013.01); *E05B 15/00* (2013.01)

(58) Field of Classification Search
CPC . E05B 9/08; E05B 9/082; E05B 15/00; E05B 15/0033; E05B 15/0053; E05B 17/0004
See application file for complete search history.

(56) References Cited

U.S. PATENT DOCUMENTS 4,672,829 A 6/1987 Gater
4,869,083 A 9/1989 DeMarseilles
5,317,889 A 6/1994 Solovieff
5,598,726 A 2/1997 Cordle
(Continued)

FOREIGN PATENT DOCUMENTS

CN 1103697 A 6/1995
CN 1243189 A 2/2000
(Continued)

OTHER PUBLICATIONS

Lien-Hsi Huang et al., Title of Invention: Lock, Method for Dismounting Lock and Method for Mounting Lock, U.S. Appl. No. 16/561,021, filed Sep. 5, 2019.

*Primary Examiner* — Christopher J Boswell
(74) *Attorney, Agent, or Firm* — Winston Hsu

(57) ABSTRACT

A fixing structure for a lock includes a mounting plate, a cover plate, and a drive plate. The mounting plate is fixedly disposed on a door plank and includes a guided post and a locking slot structure. The cover plate includes an obstruction post, a guiding slot, and an engaging structure. The drive plate has a protruding tab and is rotatably disposed on the cover plate. The cover plate aligns with the mounting plate through the guided post being slidably disposed in the guiding slot. The drive plate is configured to rotate with the cover plate such that the engaging structure engages the locking slot structure. A lock includes two handle sets and the fixing structure. One of the handle sets and the mounting plate are fixedly disposed at opposite sides of the door plank. The other handle set passes through the cover plate and connects with the drive plate.

9 Claims, 15 Drawing Sheets

(56) References Cited

U.S. PATENT DOCUMENTS

| | | | | |
|---|---|---|---|---|
| 5,712,626 | A | 1/1998 | Andreou | |
| 5,732,578 | A | 3/1998 | Kang | |
| 5,761,936 | A | 6/1998 | Katayama | |
| 6,048,007 | A | 4/2000 | Shor | |
| 6,241,295 | B1 | 6/2001 | Hoogendoorn | |
| 6,264,255 | B1 | 7/2001 | Fortune | |
| 6,568,231 | B1 * | 5/2003 | Huang | E05B 13/004 292/358 |
| 6,598,440 | B1 | 7/2003 | Armstrong | |
| 6,644,077 | B1 * | 11/2003 | Huang | E05B 13/004 292/358 |
| 6,745,602 | B2 | 6/2004 | Nakasone | |
| 6,988,751 | B2 | 1/2006 | Fishencord | |
| 7,066,507 | B2 | 6/2006 | Don | |
| 7,311,342 | B1 | 12/2007 | Fan | |
| 8,360,489 | B2 | 1/2013 | Cho | |
| 8,746,760 | B2 | 6/2014 | Chen | |
| 9,267,311 | B2 | 2/2016 | Huang | |
| 10,844,633 | B2 | 11/2020 | Qiu | |
| 2002/0104345 | A1 | 8/2002 | Wang | |
| 2003/0121300 | A1 | 7/2003 | Wang | |
| 2004/0189022 | A1 | 9/2004 | Don | |
| 2005/0184538 | A1 | 8/2005 | Huang | |
| 2007/0096479 | A1 * | 5/2007 | Lin | E05B 9/08 292/336.3 |
| 2011/0006550 | A1 | 1/2011 | Cho | |
| 2014/0319858 | A1 * | 10/2014 | Huang | E05B 3/003 292/357 |
| 2020/0318386 | A1 * | 10/2020 | Huang | E05B 9/04 |

FOREIGN PATENT DOCUMENTS

| | | | |
|---|---|---|---|
| CN | 1297097 | A | 5/2001 |
| CN | 1068651 | C | 7/2001 |
| CN | 2690515 | Y | 4/2005 |
| CN | 201087589 | Y | 7/2008 |
| CN | 202039660 | U | 11/2011 |
| GB | 2 272 252 | B | 7/1996 |
| JP | 9-317286 | A | 12/1997 |
| JP | 2012-237121 | A | 12/2012 |
| JP | 5723210 | B2 * | 5/2015 |

* cited by examiner

FIXING STRUCTURE FOR LOCK, AND LOCK THEREWITH

BACKGROUND OF THE INVENTION

1. Field of the Invention

The present invention relates to a lock, and more particularly, to a fixing structure used to fix a cover plate of a lock.

2. Description of the Prior Art

A typical door lock comprises an exterior handle set, an interior handle set, and a latch all assembled and mounted to a door plank. The latch is typically mounted on the door plank first. Then, the interior and exterior handle sets on either side of the door plank are aligned with and connected to the latch device. Finally, the interior and exterior handle sets are aligned with and fixedly connected to each other using screws. Not only are the positions of each handle set difficult to maintain during the process of driving the screws, the shape of the handle sets may also prevent screwdrivers from driving the screws in a normal manner; the screwdrivers may need to be tilted to drive the screws, thereby reducing the effectiveness of the screws in securing and holding the handle sets. Therefore, assembling and mounting the door lock using the aforementioned method may be inconvenient for a user, and the quality of the assembled product may suffer.

SUMMARY OF THE INVENTION

With the aforementioned issues in mind, the present invention provides a fixing structure for a lock that utilizes a drive plate to drive and rotate a cover plate, which then engages a mounting plate structure and secures the cover plate.

The fixing structure for a lock of the present invention comprises a mounting plate, a cover plate and a drive plate. The mounting plate comprises a mounting plate body and a guided post parallel to a rotating axis extended from the mounting plate body. The mounting plate body has a locking slot structure. The cover plate comprises a cover plate body and an obstruction post; the obstruction post extends from the cover plate body, the cover plate body has a guiding slot and an engaging structure, and the guiding slot extends in a direction around the rotating axis. The drive plate is rotatably disposed on the cover plate body relative to the rotating axis while having a protruding tab, and the protruding tab extends in a direction perpendicular to the rotating axis. Wherein, the mounting plate is fixedly disposed on a door plank and the cover plate is aligned with the mounting plate through the guided post sliding in the guiding slot. In this manner, the cover plate is slidably disposed on the mounting plate relative to the guided post. The drive plate can be operated to rotate such that the protruding tab abuts against the obstruction post and drives the cover plate to rotate with the drive plate, thereby allowing the engaging structure to engage the locking slot structure and complete the process to secure the cover plate. In this manner, the user can rotate the drive plate (for example, through rotating a handle of a lock) during the mounting process to simultaneously rotate the cover plate and secure the cover plate on the mounting plate without using screws. Therefore, the fixing structure for a lock of the present invention is able to overcome the inconvenience in assembling and mounting a lock using screws as described in the prior art and reduces the difficulty in maintaining the quality of the assembled product.

Another objective of the present invention is to provide a lock with a cover plate that engages a mounting plate while the cover plate is driven to rotate by a drive plate, such that the cover plate can be secured.

According to the present invention, the lock comprises a first handle set, a second handle set and the aforementioned fixing structure for a lock. The first handle set and the mounting plate are fixedly disposed on opposite sides of the door plank. The second handle set comprises a handle set body and an axial tube, wherein the handle set body is connected to the axial tube and the axial tube is passed through the cover plate and connected to the drive plate. In a similar manner when mounting the lock, the user can rotate the drive plate (for example, by rotating the second handle set body) to simultaneously rotate the cover plate and secure the cover plate to the mounting plate without using screws. Therefore, the fixing structure for a lock of the present invention is able to overcome the inconvenience in assembling and mounting the lock using screws as described in the prior art and reduces the difficulty in maintaining the quality of the assembled product.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
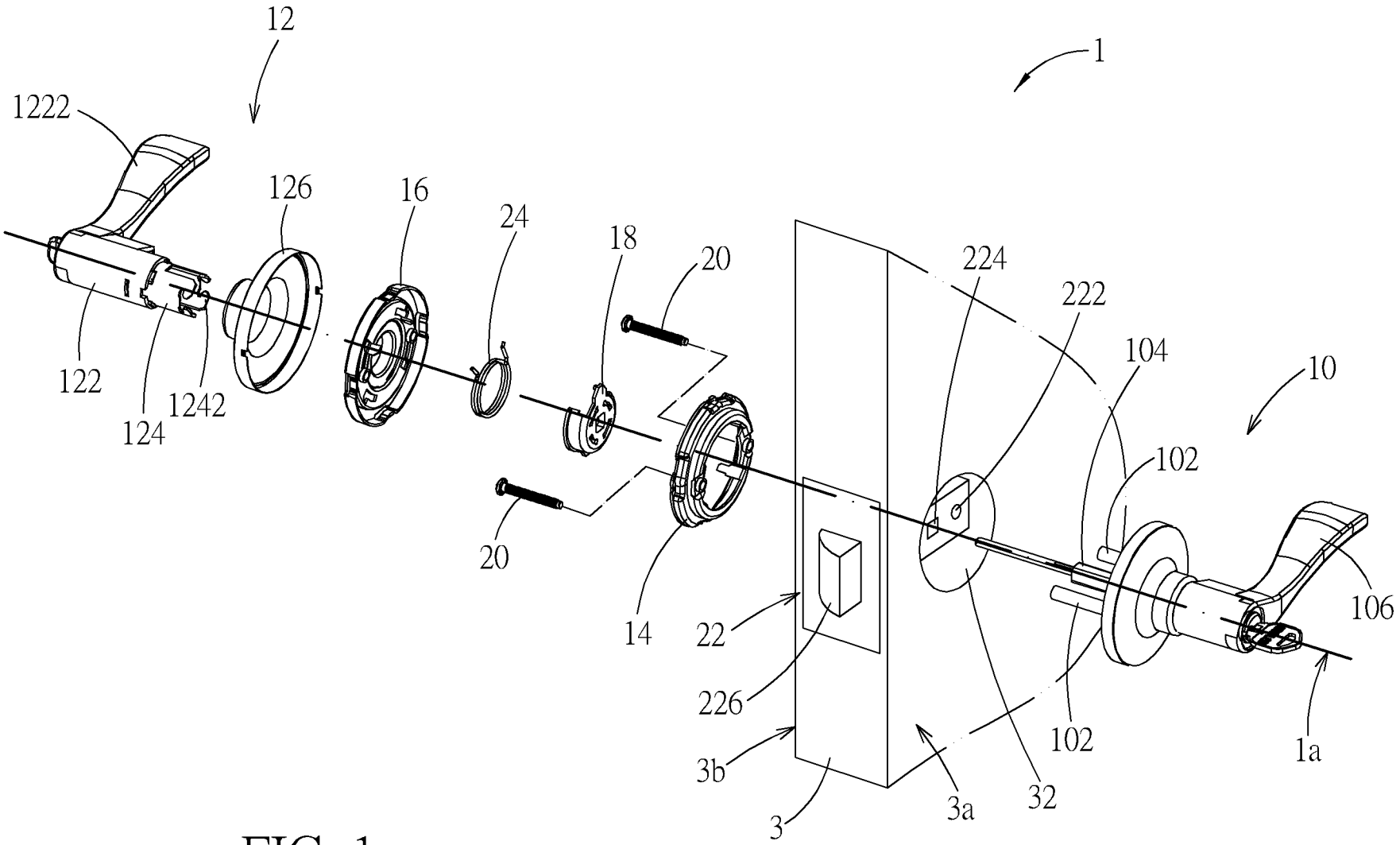
FIG. 1 is a partial exploded diagram illustrating a lock according to an embodiment of the present invention.

Please refer to FIG. 1. According to an embodiment of the present invention, a lock 1 with a rotating axis 1*a* (shown as a chain line) is mounted to a door plank 3 through a mounting hole 32. The lock 1 comprises a first handle set 10, a second handle set 12, a mounting plate 14, a cover plate 16, a drive plate 18, two screws 20 and a latch device 22. The latch device 22 is fixed to the door plank 3. The mounting plate 14 and the first handle set 10 is fixedly disposed on a side 3*a* and a side 3*b* of the door plank 3 through screws 20, wherein the first handle set 10 having two screw posts 102 is positioned on the side 3*a*. The screw posts 102 pass through the mounting hole 32 and through holes 222 of the latch device 22. The mounting plate 14 is substantially a cup-shaped ring partially placed into the mounting hole 32 and protrudes from the other side 3*b* of the door plank 3. The mounting plate 14 has two locking holes 142 matching the two screw posts 102. The two screws 20 pass through the locking holes 142 from a side 3*b* and are driven into the matching screw posts 102. In practical applications, the mounting plate 14 is not limited to being fixedly connected to the first handle set 10; for example, the mounting plate 14 and the first handle set 10 can separately align with the latch device 22 to be secured on the door plank 3.

The second handle set 12 comprises a handle set body 122 and an axial tube 124. The handle set body 122 is connected to the axial tube 124 such that when the handle 1222 of the handle set body 122 is rotated, the axial tube 124 is rotated together with the handle 1222. The axial tube 124 passes through the cover plate 16 to connect to the drive plate 18 (the connection is performed via passing the bent end 1242 of the axial tube 124 through the attaching slot 182 of the drive plate 18 to hold the drive plate 18) such that when the axial tube 124 rotates, the drive plate 18 rotates with the axial tube 124. The cover plate 16 can be connected to the mounting plate 14 through the drive plate 18; the details of such connection will be described in the following paragraphs. The aforementioned configuration regarding the mounting plate 14, the cover plate 16, the drive plate 18, and more specifically, the second handle set 12 provides the fixing structure for the lock. Additionally, the second handle set 12 further comprise a decorative plate 126 tightly placed over the cover plate 16 for decoration after the cover plate 16 is secured. Furthermore, the first handle set 10 and the second handle set 12 are also connected through a transfer tube 104, the transfer tube 104 being extended along the rotating axis 1*a* while passing through and engaging with the transfer slot 224 of the latch device 22 so that a latch tongue 226 of the latch device 22 can be driven to move. In this manner, when a handle 106 of the first handle set 10 or a handle 1222 of the second handle set 12 is rotated, the transfer tube 104 can be rotated with the handles to drive the latch tongue 226 to move. The lock 1 further comprises a recovery device 24 (such as a torsion spring) disposed between the cover plate 16 and the drive plate 18. The recovery device 24 provides a recovery force to return the first handle set 10 and the second handle set 12 to an original position. In practical application, the recovery device 24 can also be disposed on a side of the first handle set 10.

Please refer to FIGS. 2-5. The mounting plate 14 comprises a mounting plate body 144 and four guided posts 146. The guided posts 146 extend from the mounting plate body 144 along a direction parallel to the rotating axis 1*a*. The mounting plate body 144 has four locking slot structures 148 evenly distributed around the perimeter of the mounting plate body 144. In the present embodiment, the mounting plate body 144 is substantially a cup-shaped ring, and the locking slot structure 148 is formed by a peripheral wall of the ring. The locking slot structure 148 comprises an entrance portion 1482, a raised portion 1484 and a holding portion 1486. The cover plate 16 comprises a cover plate body 162 and an obstruction post 164, the obstruction post 164 being extended from the cover plate body 162. The cover plate body 162 has four guiding slots 166 and four engaging structures 168, and the guiding slot 166 is extended around the rotating axis 1*a* (as an arc). The engaging structure 168 is positioned around the perimeter of the cover plate body 162. In the present embodiment, the engaging structure 168 is formed by a peripheral wall of the cover plate body 162. The engaging structure 168 comprises an elastic raised portion 1682 protruding toward an interior of the cover plate body 162. The cover plate 16 is engaged with the locking slot structure 148 through the engaging structure 168 and fixed to the mounting plate 14, and the peripheral wall of the mounting plate body 144 is substantially fitted with the peripheral wall of the cover plate body 162.

Additionally, the cover plate body 162 has a containing slot 170 and a bushing 172. The containing slot 170 houses or contains the drive plate 18, and the bushing 172 connects to the bottom of the containing slot 170. The axial tube 124 can freely rotate and pass through the bushing 172 while being supported by the bushing 172. Please also refer to FIG. 6. The drive plate 18 comprises a drive plate body 184 and a first protruding tab 186. The drive plate body 184 is rotatably contained by the containing slot 170 relative to the rotating axis 1*a*, and the first protruding tab 186 extends from the drive plate body 184 in a direction perpendicular to the rotating axis 1*a* out of the containing slot 170. The obstruction post 164 of the cover plate 16 is positioned within the range of rotation of the first protruding tab 186 relative to the rotating axis 1*a*. Therefore, when the drive plate 18 rotates relative to the cover plate 16, the first protruding tab 186 is able to abut against the obstruction post 164 such that the drive plate 18 can drive the cover plate 16 to rotate with the drive plate 18. Furthermore, in the present embodiment, the drive plate body 184 is configured as a cylinder with cut-outs or notches in order to house or contain the recovery device 24.

Figure 7:
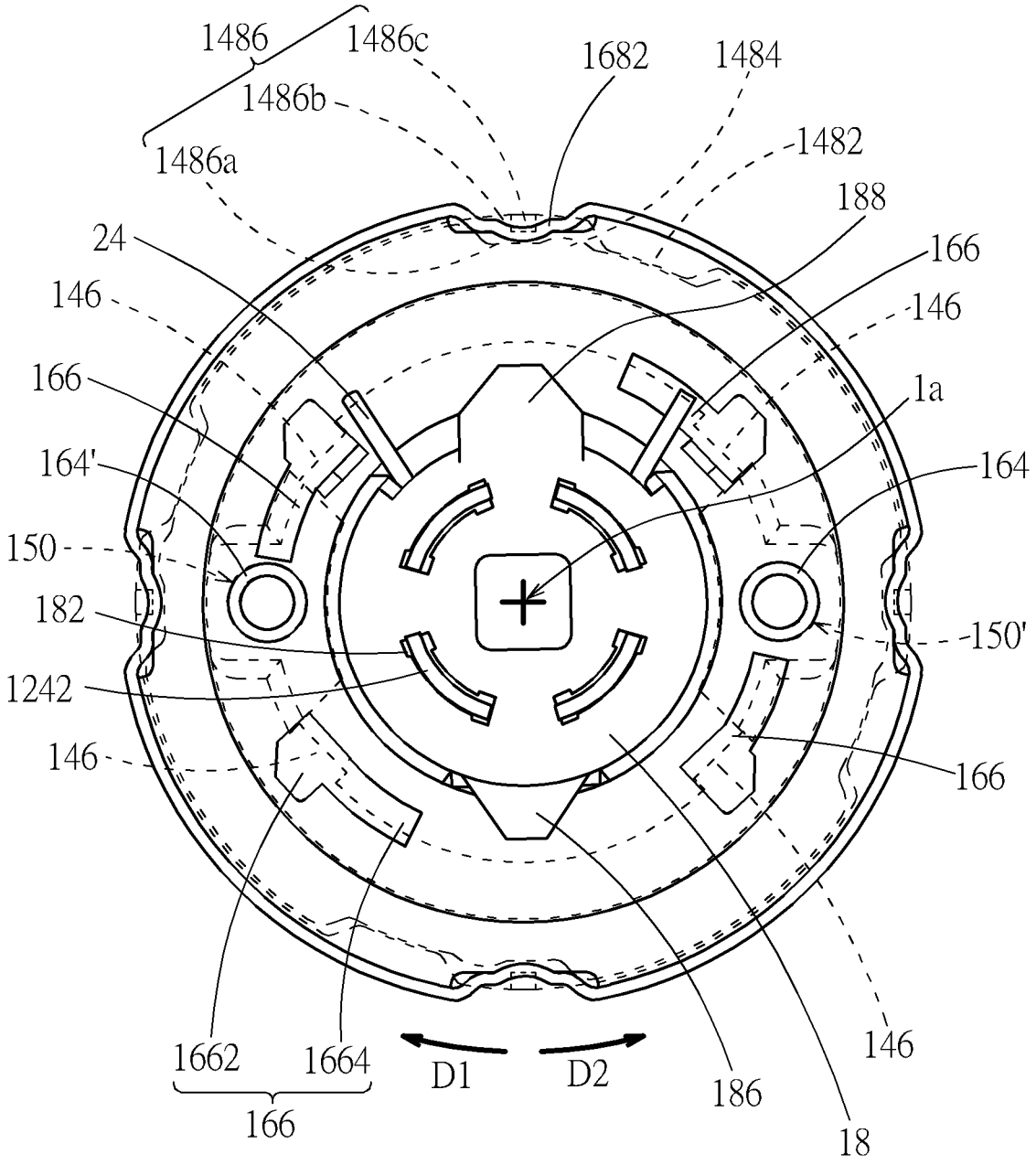
FIG. 7 is a schematic diagram of a view from the first handle set toward the second handle set of the cover plate assembled to the mounting plate, and an outline of the mounting plate is shown in dashed lines.
Figure 8:
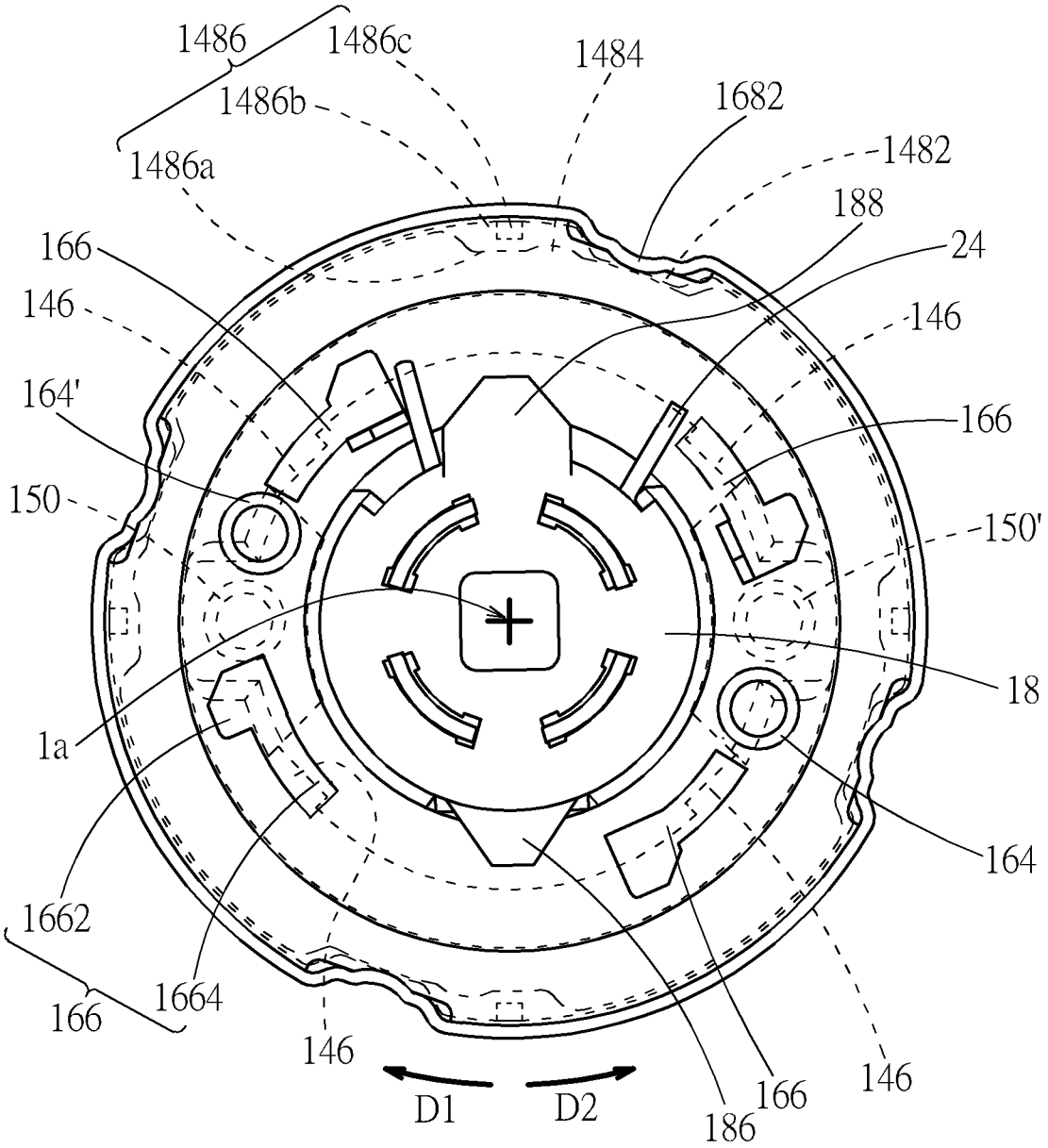
FIG. 8 is another schematic diagram of a view of the cover plate assembled to the mounting plate, wherein the cover plate is rotated in a direction to an angle relative to the mounting plate.

When the lock 1 is mounted to the door plank 3, the mounting plate 14 and the first handle set 10 are fixedly disposed on the door plank 3 first. The second handle set 12 and the cover plate 16 along with the drive plate 18 are then assembled together. Subsequently, the cover plate 16 and the mounting plate 14 are engaged with each other. Please also refer to FIG. 7-10. When mounting the second handle set 12 to the mounting plate 14, the cover plate 16 is brought close to and aligned with the mounting plate 14, wherein the elastic raised portion 1682 is aligned with the holding portion 1486 of the locking slot structure 148, as shown in FIG. 7. Such arrangement helps the guided post 146 to be inserted into the guiding slot 166 and facilitates further operation. The guiding slot 166 of the present embodiment has an entrance end 1662 and a closed end 1664. The entrance end 1662 is an end with an opening larger than the rest of the guiding slot 166; such configuration helps the guided post 146 to be inserted into the guiding slot 166 through the entrance end 1662. Next, the cover plate 16 is rotated relative to the rotating axis 1*a* (shown in the figure as a cross) or relative to the mounting plate 14 in a first direction D1 at a first angle. In this manner, the elastic raised portion 1682 is aligned with the entrance portion 1482 of the locking slot structure 148, as shown in FIG. 8. Here, when the cover plate 16 is rotated, the guided post 146 also moves relative to the guiding slot 166. Additionally, when the guided post 146 moves to the closed end 1664, the elastic raised portion 1682 will align with the entrance portion 1482. In this configuration, when the user rotates the cover plate 16 directly such that the closed end 1664 abuts the guided post 146, the elastic raised portion 1682 and the entrance portion 1482 can be aligned. Next, the cover plate 16 can be moved toward the mounting plate 14 (or the door plank 3) such that the elastic raised portion 1682 can enter the locking slot structure 148 through the entrance portion 1482. Here, the peripheral wall of the mounting plate body 144 is substantially closely fitted with the peripheral wall of the cover plate body 162.

Figure 9:
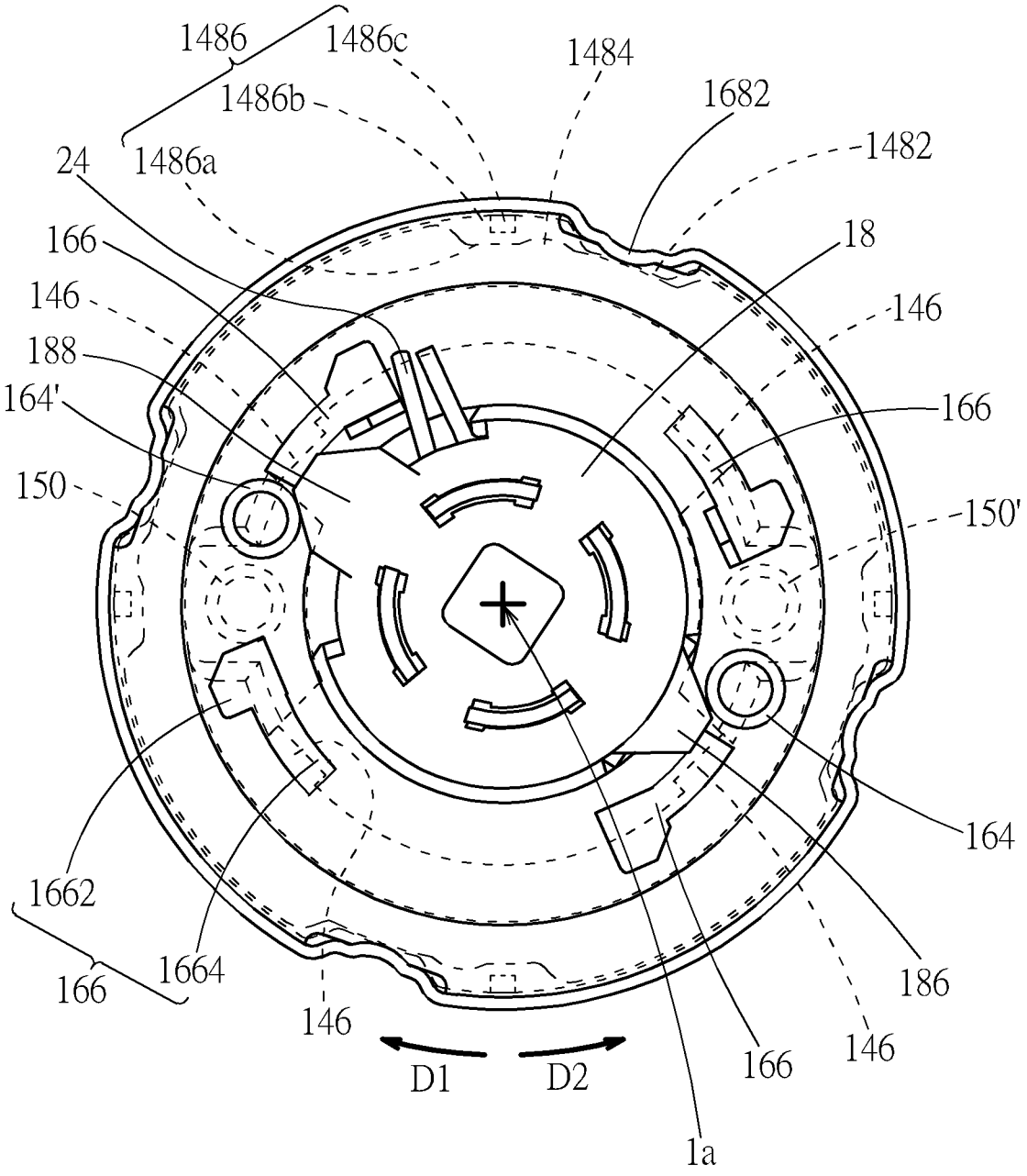
FIG. 9 is another schematic diagram of a view of the cover plate assembled to the mounting plate, wherein the drive plate is rotated to another angle in an opposite direction (in reference to FIG. 8) relative to the cover plate.
Figure 10:
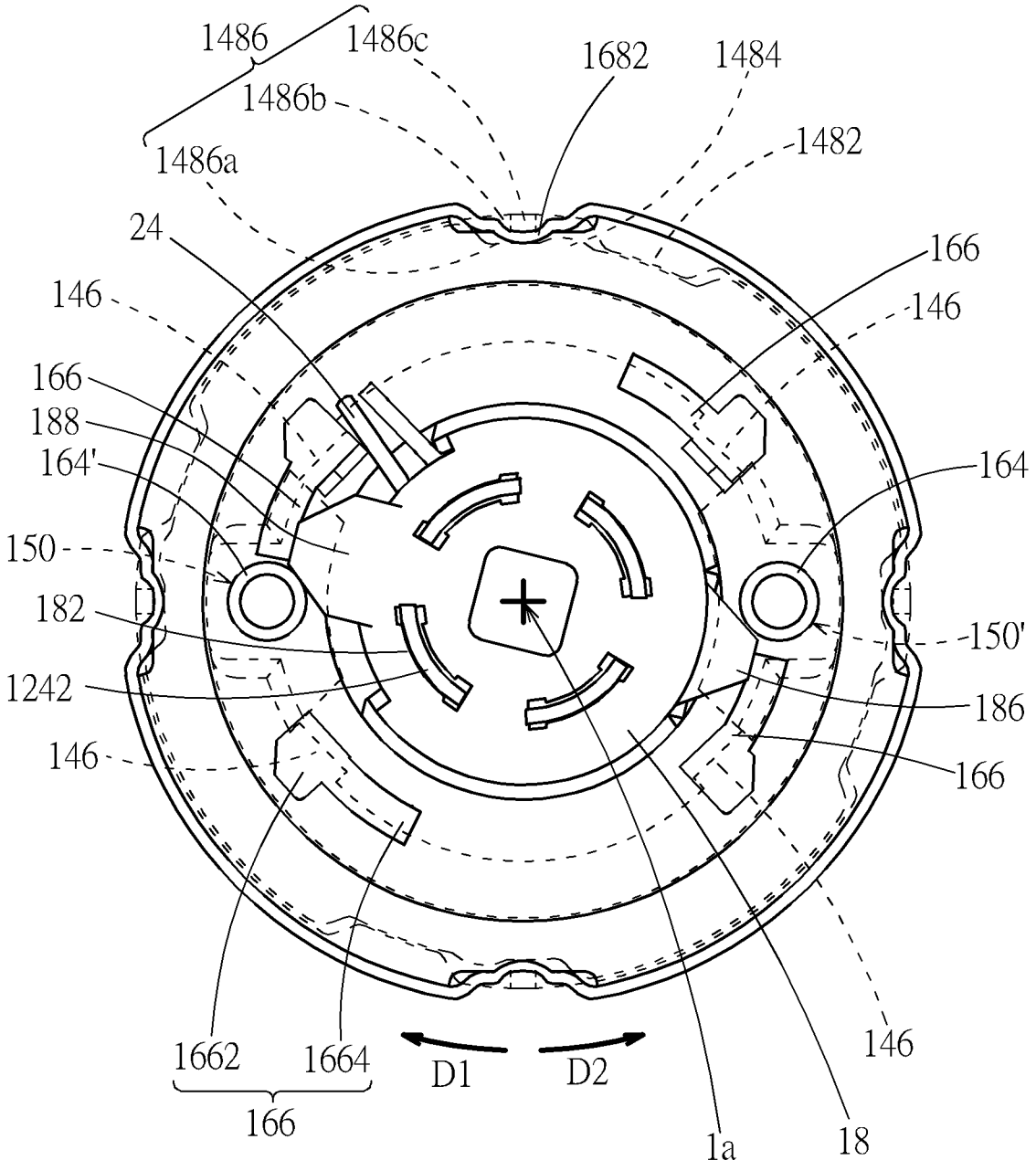
FIG. 10 is another schematic diagram of a view of the cover plate assembled to the mounting plate, wherein the drive plate together with the cover plate continue to rotate to a third angle in the opposite direction (in reference to FIG. 8) relative to the mounting plate.
Figure 11:
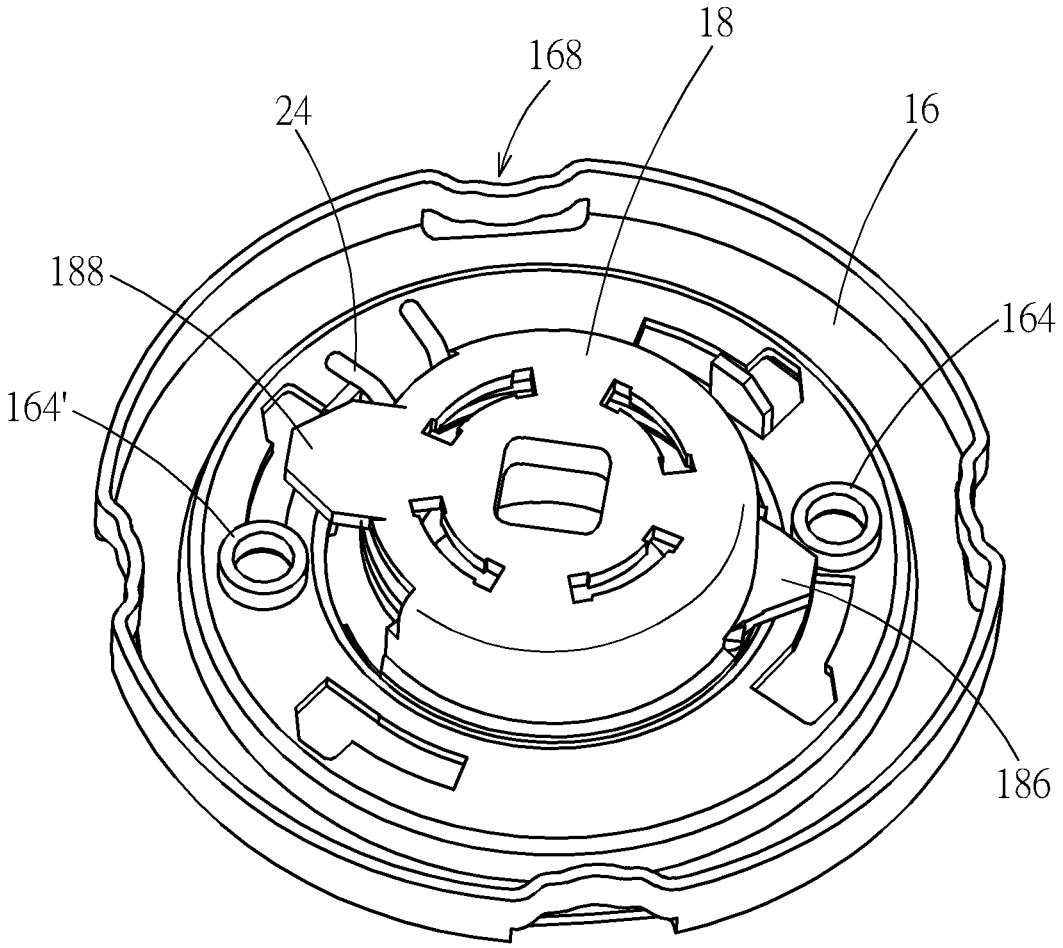
FIG. 11 is a schematic diagram of the drive plate and the cover plate of FIG. 10.

Subsequently, the drive plate 18 is rotated in a second direction D2 (opposite from the first direction D1) relative to the rotating axis 1*a* (or relative to the cover plate 16) by, for example, rotating the handle 1222 and letting the axial tube 124 drive the rotation, such that the first protruding tab 186 abuts the obstruction post 164, as shown in FIG. 9. Then, the drive plate 18 continues to drive the cover plate 16 to simultaneously rotate in the second direction D2 through the first protruding tab 186, until the engaging structure 168 and the locking slot structure 148 are engaged, as shown in FIG. 10. (Please also refer to FIG. 11, which shows the first protruding tab 186 abutting against the obstruction post 164). Here, when the first protruding tab 186 drives the cover plate 16 to simultaneously rotate, the elastic raised portion 1682 slidably abuts against the raised portion 1484 while elastically deforming in a way for the elastic raised portion 1484 to be held by the holding portion 1486, allowing the engaging structure 168 to be engaged with the locking slot structure 148, thereby achieving an effect of securing the cover plate 16 to the mounting plate 14. Next, the drive plate 18 is returned to the original position (for example, through the recovery device 24) by rotating in the first direction D1 relative to the cover plate 16. At this time, the first handle set 10 and the second handle set 12 can be operated normally to drive the latch tongue 226. Herein, the relative positions of the mounting plate 14, the cover plate 16 and the drive plate 18 are identical to those shown in FIG. 7 and will no longer be described for simplicity.

Figure 6:
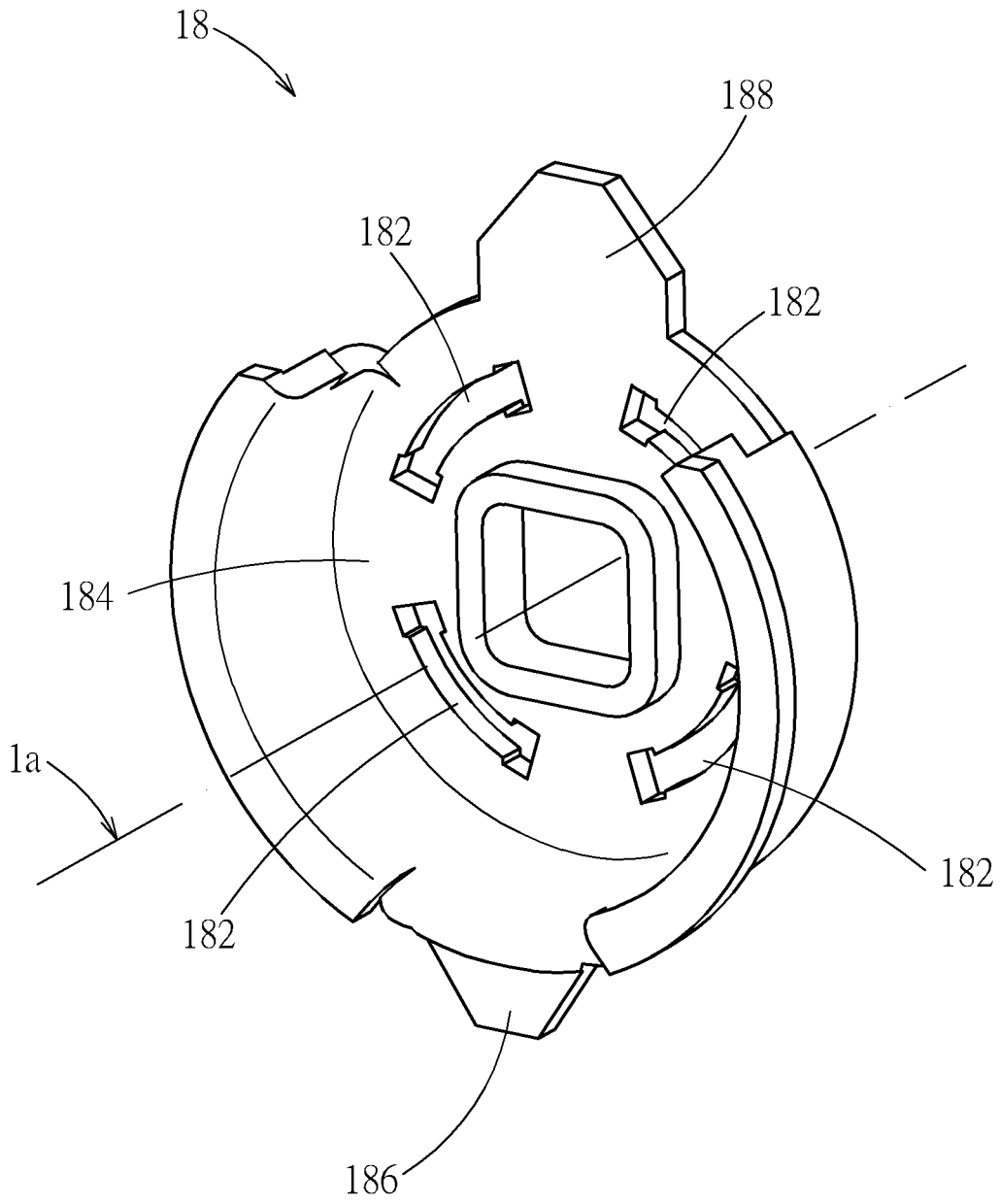
FIG. 6 is a schematic diagram of a drive plate of the lock of FIG. 1.
Figure 12:
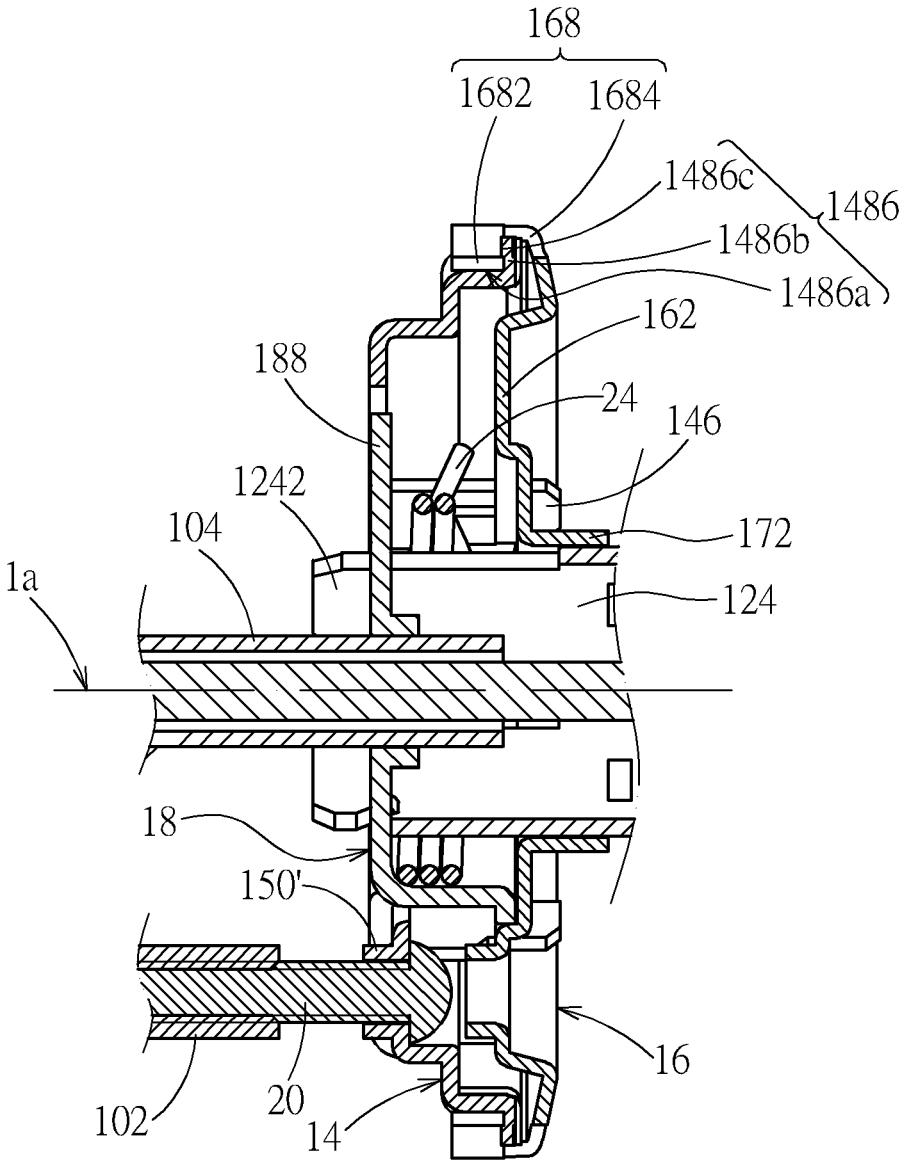
FIG. 12 is a partial sectional view of the lock after the lock is mounted on the door plank, and the door plank is not shown.

Furthermore, please refer to FIGS. 6 and 12. In the present embodiment, the drive plate 18 has a second protruding tab 188, and a position of the first protruding tab 186 relative to the rotating axis 1*a* is offset from a position of the second protruding tab 188. The second protruding tab 188 is closer to the first handle set 10 than the first protruding tab 186. The second protruding tab 188, when rotating relative to the rotating axis 1*a*, will not interfere with the obstruction post 164 of the cover plate 16. However, the second protruding tab 188 will interfere with a limiting post 150 connected to the mounting plate body 144. In the present embodiment, the limiting post 150 is a locking hole post (that is, the limiting post 150 is formed from the locking holes 142 passing through the mounting plate 14), but the present invention is not limited thereto. For example, another structural post can be formed on the mounting plate 14 as a limiting post. Please also refer to FIG. 10. As shown in FIG. 10, when the engaging structure 168 is engaged with locking slot structure 148, the limiting post 150 blocks the second protruding tab 188 and prevents both the drive plate 18 and the cover plate 16 from continuing to rotate in the second direction D2. This structural configuration helps to prevent the cover plate 16 from over rotating relative to the mounting plate 14 and damaging the engaging structure 168, the locking slot structure 148 or other components of the lock 1. The configuration also helps the user to rotate the handle 1222 such that the engaging structure 168 can engage the locking slot structure 148. In practical application, the aforementioned mechanism preventing the cover plate 16 from over rotating can also be realized through motion interference between the second protruding tab 188 and other structures fixedly connected to the mounting plate 14. For example, the position of the second protruding tab 188 relative to the rotating axis 1*a* can be modified such that the second protruding tab 188 is closer to the first handle set 10; in this way, the second protruding tab 188 will interfere with a body of the screw 20 during movement. Therefore, the body of the screw 20 can be used as the limiting post of the second protruding tab 188. As another example, the position of the second protruding tab 188 relative to the rotating axis 1*a* can be modified such that the second protruding tab 188 is farther away from the first handle set 10; in this way, the second protruding tab 188 will interfere with a head of the screw 20 during movement. Therefore, the head of the screw 20 can be used as the limiting post of the second protruding tab 188.

In the present embodiment, the obstruction post 164 and the limiting post 150 (or the locking hole post) are symmetrically disposed relative to the rotating axis 1*a*. Please refer to FIGS. 10 and 11. After the lock 1 is mounted and when the drive plate 18 is rotated in the first direction D1 to a position where the first protruding tab 186 abuts the obstruction post 164', the second protruding tab 188 also abuts the limiting post 150' such that the drive plate 18 can no longer rotate in the first direction D1, and the cover plate 16 can no longer be driven to rotate by the drive plate 18 in a way for the engaging structure 168 to separate from the locking slot structure 148. In practical application, the lock 1 may be mounted with only one obstruction post 164 (which interferes with a motion of the first protruding tab 186) and only one limiting post 150 (which interferes with a motion of the second protruding tab 188). If the lock 1 is mounted in this configuration, even if the drive plate 18 is rotated in the first direction D1 to the position where the first protruding tab 186 abuts the obstruction post 164, the second protruding tab 188 will also abut the limiting post 150 such that the drive plate 18 can no longer continue to rotate in the first direction D1, and the cover plate 16 will no longer be driven to rotate by the drive plate 18 in a way for the engaging structure 168 to separate from the locking slot structure 148.

Figure 2:
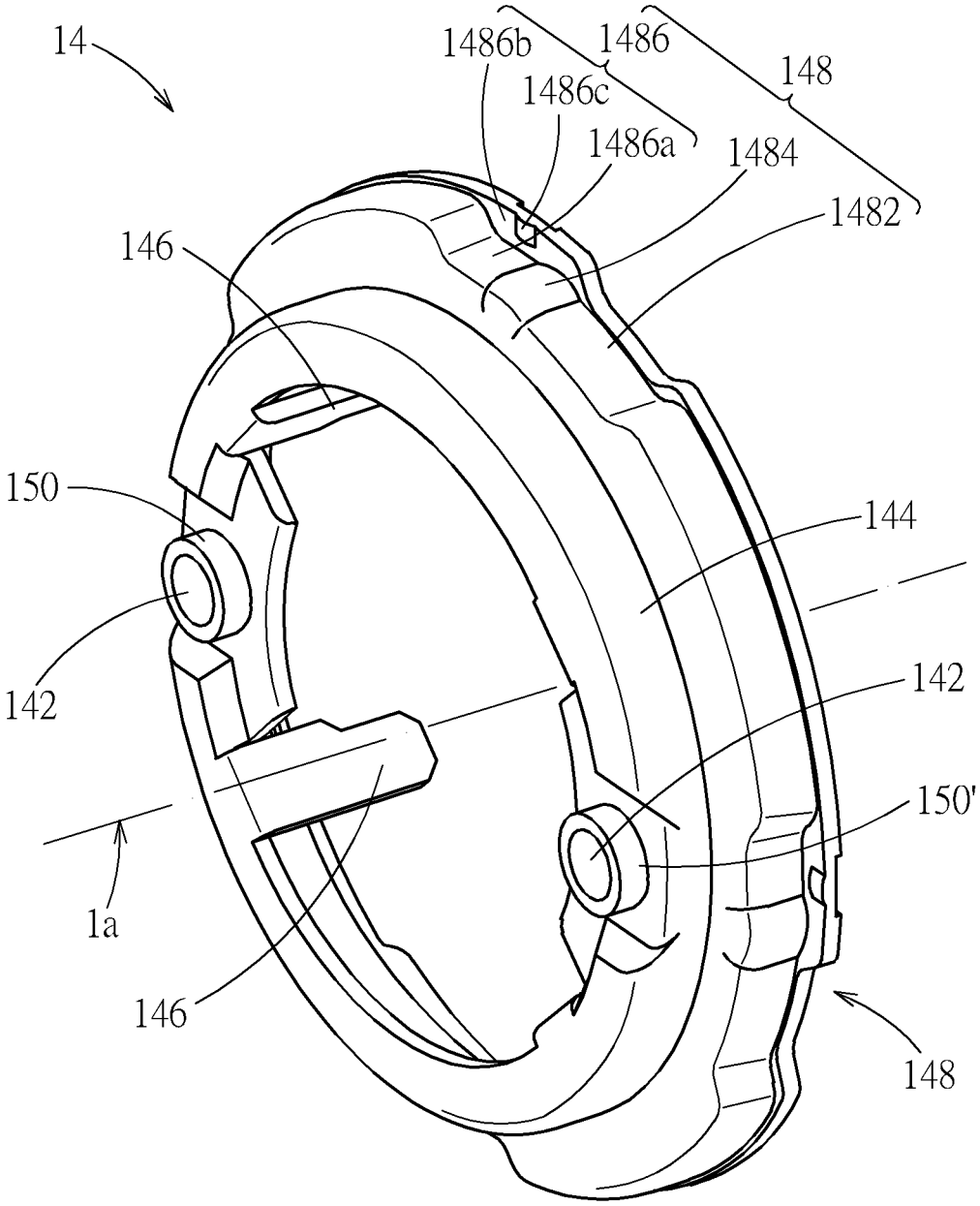
FIG. 2 is a schematic diagram of a mounting plate of the lock of FIG. 1.
Figure 3:
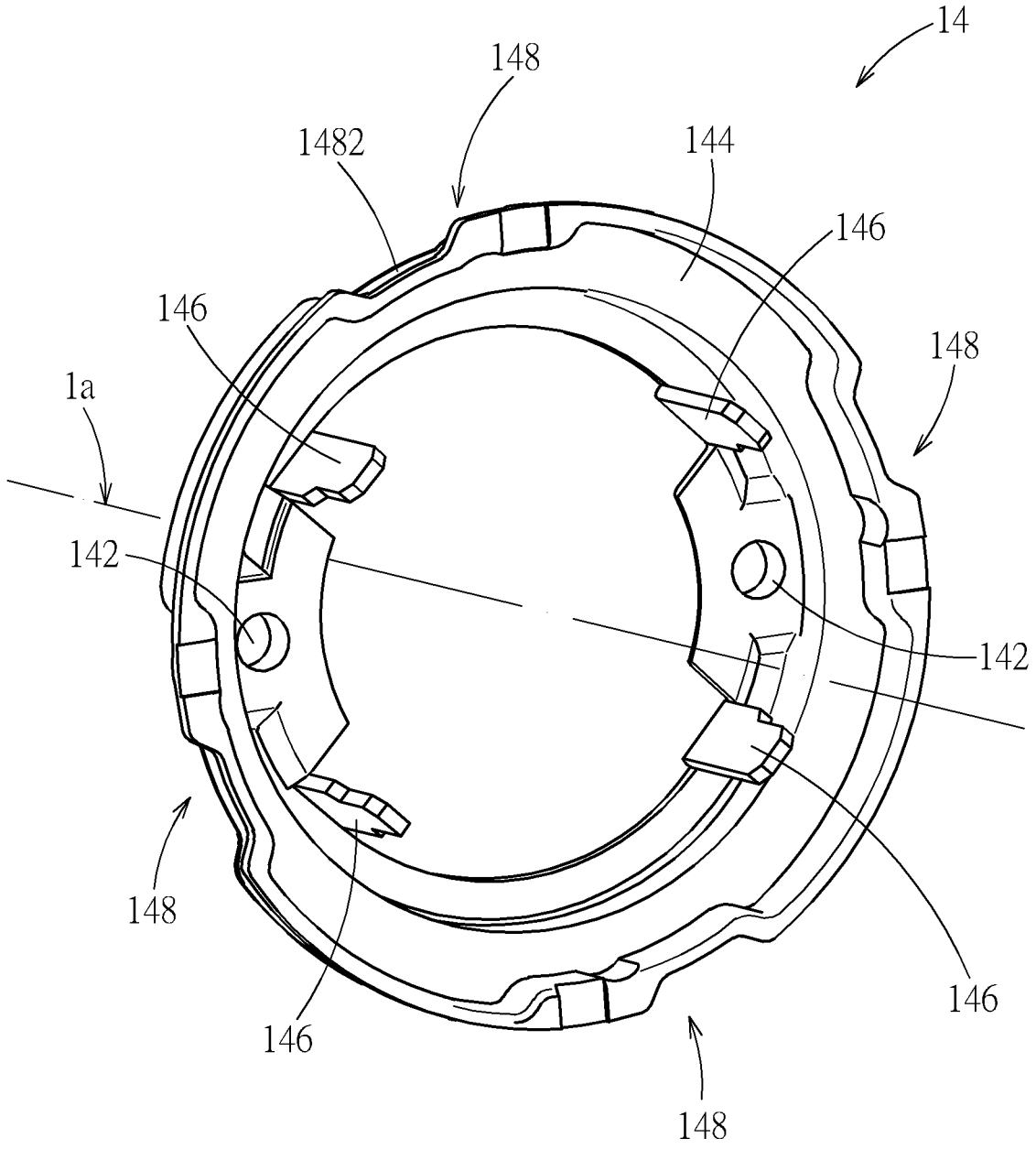
FIG. 3 is a schematic diagram of the mounting plate of FIG. 2 from another view.
Figure 4:
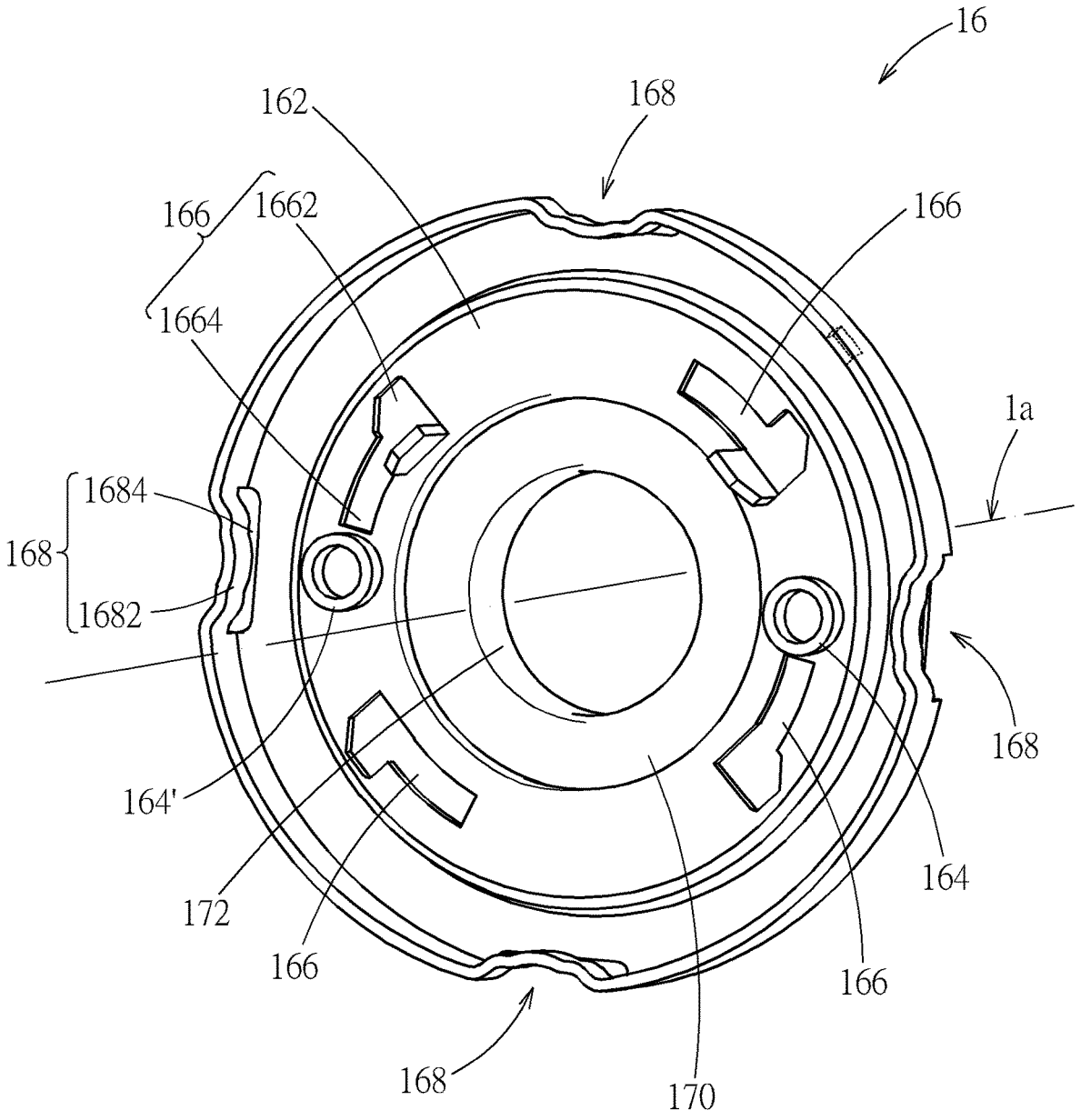
FIG. 4 is a schematic diagram of a cover plate of the lock of FIG. 1.
Figure 5:
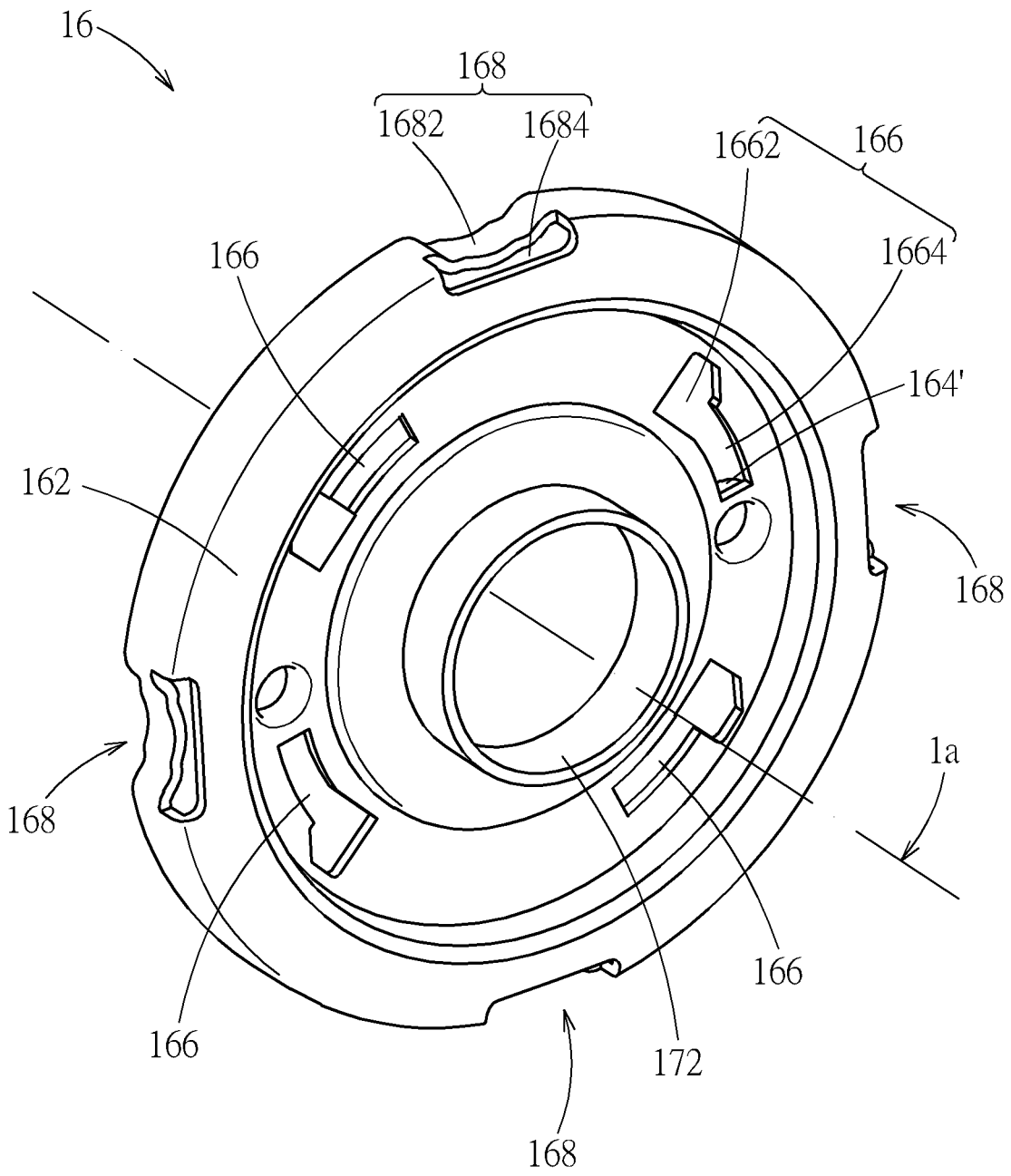
FIG. 5 is a schematic diagram of the cover plate of FIG. 4 from another view.
Figure 13:
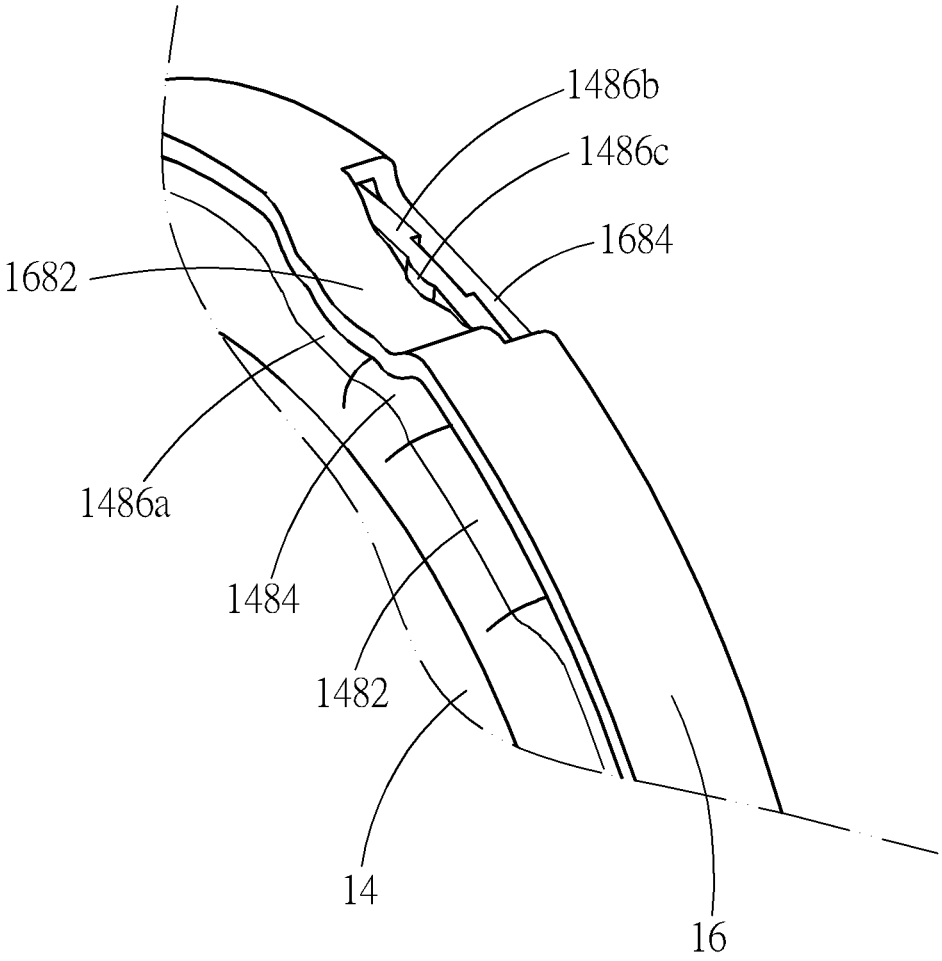
FIG. 13 is a partial diagram of the engaging structure of the cover plate after being engaged with the locking slot structure of the mounting plate.

Regarding the connection between the locking slot structure 148 and the engaging structure 168, it is worth noting that in the present embodiment shown in FIG. 2 and FIG. 3, the holding portion 1486 of the locking slot structure 148 comprises a notch 1486*a*, a baffle 1486*b* and a protruding part 1486*c*. The baffle 1486*b* is next to the notch 1486*a* and extends in a direction perpendicular to the rotating axis 1*a*. The protruding part 1486*c* extends from the baffle 1486*b* in a direction parallel to the rotating axis 1*a* and toward the notch 1486*a*. As shown in FIGS. 4 and 5, the engaging structure 168 comprises an opening 1684 between the elastic raised portion 1682 and the cover plate body 162. Please also refer to FIG. 13. When the engaging structure 168 engages the holding portion 1486, the elastic raised portion 1682 is held by the notch 1486*a* and the baffle 1486*b* is inserted between the elastic raised portion 1682 and the cover plate body 162 (or inserted into the opening 1684), while the elastic raised portion 1682 is held between the notch 1486*a* and the protruding part 1486*c*. Such structural configuration helps to increase the engaging strength of the locking slot structure 148 and the engaging structure 168, so that the cover plate 16 can be securely fixed onto the mounting plate 14.

When the lock 1 is to be removed from the door plank 3, the decorative plate 126 can be configured with a hole (not shown) exposing the opening 1684; the decorative plate 126 can also be separated from the cover plate 16 first to expose the opening 1684. Then, a tool (such as a flat-head screwdriver) can be used to press against the opening 1684 and apply a force for the cover plate 16 to rotate in the first direction D1, such that the elastic raised portion 1682 separates from the holding portion 1486. Alternatively, the periphery of the cover plate 16 can be configured with a notch while the decorative plate 126 can be configured with an opening exposing the notch (not shown), so that the user can use the tool (such as a flat-head screwdriver) to press against the notch and apply a force for the cover plate 16 to rotate in the first direction D1, such that the elastic raised portion 1682 separates from the holding portion 1486, without having to remove the decorative plate 126 first. Subsequently, the cover plate 16 can be separated from the mounting plate 14 and the second handle set 12 can be removed from the door plank 3, followed by the removal of the screws 20, the mounting plate 14, the first handle set 10 and the latch device 22, finally completing the removal of the lock 1.

Figure 14:
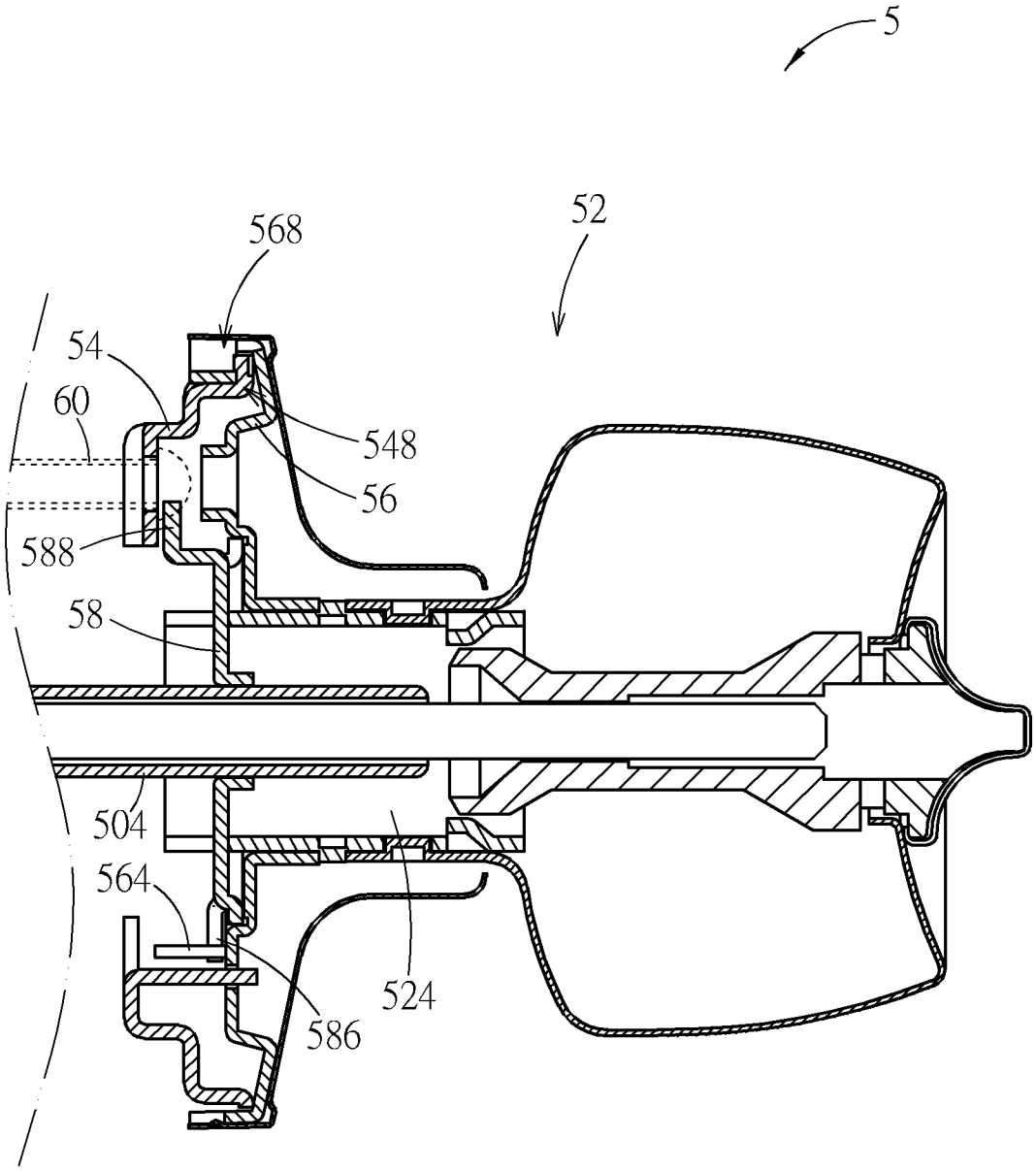
FIG. 14 is a partial sectional view of the lock according to another embodiment of the present invention.

As described in the previous sections, the present embodiment shows the cover plate 16 aligning with the mounting plate 14 through the guided post 146 sliding in the guiding slot 166. The drive plate 18 can be operated to rotate such that the first protruding tab 186 abuts against the obstruction post 164 and drives the cover plate 16 to rotate with the drive plate 18, thereby allowing the engaging structure 168 to engage the locking slot structure 148. As an example, the lock 1 of the aforementioned embodiment is a flat-handle lock. In practical application, the mechanism to mount the cover plate 16 to the mounting plate 14 is also suitable for a round-handle lock. Please refer to FIG. 14. According to another embodiment of the present invention, the aforementioned mechanism is also suitable for a lock 5. The lock 5 has the same operational structure as the lock 1; for simplicity, FIG. 14 only shows a partial structure of the lock 5. For a detailed description of the remaining components of the lock 5, please refer to the description in previous paragraphs regarding the components of the lock 1 with identical reference signs. In the present embodiment, the lock 5 is a round-handle lock comprising a first handle set (not shown in figure), a second handle set 52, a mounting plate 54, a cover plate 56, a drive plate 58, two screws 60 (one screw is shown in the figure in dashed lines) and a latch device (not shown in figure). The mounting plate 54 and the first handle set are fixedly disposed on opposite sides of the door plank (not shown in figure) through screws 60. The second handle set 52 is connected to the drive plate 58 through the axial tube 524. The axial tube 524 passes through the cover plate 56, and the cover plate 56 is secured by the locking slot structure 548 through the engaging structure 568 and connected to the mounting plate 54. The first handle set and the second handle set 52 are also connected through a transfer tube 504, such that the first handle set and the second handle set 52 can separately drive the latch tongue of the latch device to move.

Figure 15:
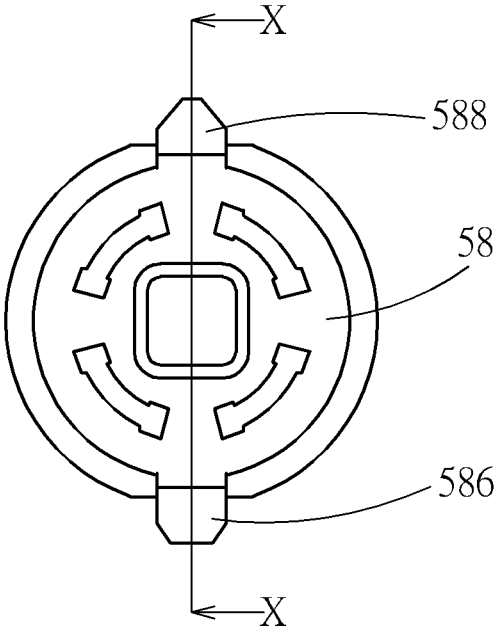
FIG. 15 is a front view of the drive plate of the lock of FIG. 14.
Figure 16:
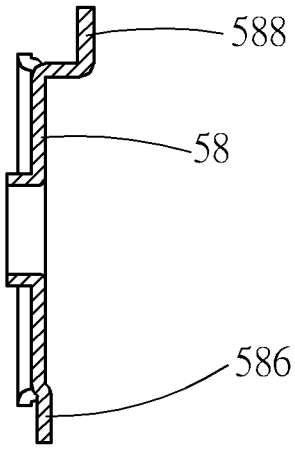
FIG. 16 is a sectional view of the drive plate of FIG. 15 along line X-X.

Please also refer to FIGS. 15 and 16. In the present embodiment, the drive plate 58 does not need to house a torsion spring; therefore, the drive plate 58 is flatter compared to the drive plate 18. The cover plate 56 that interacts with the drive plate 58 is similar to the cover plate 16; therefore, please refer to FIGS. 4 and 5 for the schematic diagram of the cover plate 56. The drive plate 58 can also be rotated such that a first protruding tab 586 abuts against an obstruction post 564 of the cover plate 56, thereby driving the cover plate 56 to rotate. On the other hand, the second protruding tab 588 of the drive plate 58 is blocked by a head of the screw 60. In this manner, the drive plate 58 is unable to continue driving the cover plate 56 to rotate. For simplicity, please refer to previous paragraphs regarding the cover plate 16 and the drive plate 18 for other details of interaction between the cover plate 56 and the drive plate 58. For descriptions on the removal of the lock 5 from the door plank, please also refer to previous paragraphs on the removal of the lock 1 from the door plank.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fixing structure for a lock comprising:

a mounting plate comprising a mounting plate body and a guided post, the guided post being parallel to a rotating axis extended from the mounting plate body, the mounting plate body having a locking slot structure;

a cover plate comprising a cover plate body and an obstruction post, the obstruction post extending from the cover plate body, the cover plate body having a guiding slot and an engaging structure, the guiding slot extending in a direction around the rotating axis; and a drive plate rotatably disposed on the cover plate body relative to the rotating axis, the drive plate having a first protruding tab, the first protruding tab extending in a direction perpendicular to the rotating axis;

wherein the mounting plate is fixedly disposed on a door plank, the cover plate is aligned with the mounting plate through the guided post sliding in the guiding slot, the drive plate can be operated to rotate such that the first protruding tab abuts against the obstruction post and drives the cover plate to rotate with the drive plate, thereby allowing the engaging structure to engage the locking slot structure;

wherein the locking slot structure is disposed around a periphery of the mounting plate body, the locking slot structure comprises an entrance portion, a raised portion, and a holding portion, the engaging structure is disposed around a periphery of the cover plate body, the engaging structure comprises an elastic raised portion, the elastic raised portion is raised toward an interior of the cover plate body, and when the engaging structure engages the locking slot structure, the elastic raised portion enters the locking slot structure through the entrance portion and slidably abuts against the raised portion while elastically deforming in a way for the elastic raised portion to be held by the holding portion.

2. The fixing structure for a lock of claim 1, wherein the holding portion comprises a notch and a baffle, and when the engaging structure is held by the holding portion, the elastic raised portion is engaged at the notch and the baffle is inserted between the elastic raised portion and the cover plate body.

3. The fixing structure for a lock of claim 2, wherein the holding portion comprises a protruding part extended from the baffle in a direction parallel to the rotating axis, the engaging structure comprises an opening between the elastic raised portion and the cover plate body, and when the engaging structure is held by the holding portion, the baffle is inserted into the opening and the elastic raised portion is held between the notch and the protruding part.

4. The fixing structure for a lock of claim 1, wherein the guiding slot has an entrance end and a closed end, the guided post enters the guiding slot through the entrance end, the guided post is positioned at the closed end when the elastic raised portion is positioned at the entrance portion, and the guided post is positioned at the entrance end when the elastic raised portion is positioned at the holding portion.

5. A fixing structure for a lock comprising:

a mounting plate comprising a mounting plate body and a guided post, the guided post being parallel to a rotating axis extended from the mounting plate body, the mounting plate body having a locking slot structure;

a cover plate comprising a cover plate body and an obstruction post, the obstruction post extending from the cover plate body, the cover plate body having a guiding slot and an engaging structure, the guiding slot extending in a direction around the rotating axis; and a drive plate rotatably disposed on the cover plate body relative to the rotating axis, the drive plate having a first protruding tab, the first protruding tab extending in a direction perpendicular to the rotating axis;

a limiting post connected to the mounting plate body;

wherein the mounting plate is fixedly disposed on a door plank, the cover plate is aligned with the mounting plate through the guided post sliding in the guiding slot, the drive plate can be operated to rotate in a direction relative to the rotating axis such that the first protruding tab abuts against the obstruction post and drives the cover plate to rotate with the drive plate, thereby allowing the engaging structure to engage the locking slot structure;

wherein the drive plate has a second protruding tab, and the limiting post blocks the second protruding tab and prevents the drive plate from rotating in the direction when the engaging structure engages the locking slot structure.

6. A lock comprising:

a fixing structure comprising:

a mounting plate comprising a mounting plate body and a guided post, the guided post being parallel to a rotating axis extended from the mounting plate body, the mounting plate body having a locking slot structure;

a cover plate comprising a cover plate body and an obstruction post, the obstruction post extending from the cover plate body, the cover plate body having a guiding slot and an engaging structure, the guiding slot extending in a direction around the rotating axis; and a drive plate rotatably disposed on the cover plate body relative to the rotating axis, the drive plate having a first protruding tab, the first protruding tab extending in a direction perpendicular to the rotating axis;

a limiting post connected to the mounting plate body;

wherein the mounting plate is fixedly disposed on a door plank, the cover plate is slidably disposed on the guiding slot through the guided post such that the cover plate aligns with the mounting plate, the drive plate can be operated to rotate in a direction relative to the rotating axis such that the first protruding tab abuts against the obstruction post and drives the cover plate to rotate with the drive plate, thereby allowing the engaging structure to engage the locking slot structure;

wherein the drive plate has a second protruding tab, and the limiting post blocks the second protruding tab and prevents the drive plate from rotating in the direction when the engaging structure engages the locking slot structure;

a first handle set fixedly disposed with the mounting plate on opposite sides of the door plank; and a second handle set comprising a handle set body and an axial tube, the handle set body being connected to the axial tube, the axial tube being passed through the cover plate and connected to the drive plate.

7. The lock of claim 6, wherein the limiting post is a screw, and the screw is connected to the mounting plate body and the first handle set.

8. The lock of claim 6, wherein the limiting post is a locking hole post, and a screw passes through the locking hole post to connect the mounting plate body and the first handle set.

9. The lock of claim 6, wherein the locking slot structure is disposed around a periphery of the mounting plate body, the locking slot structure comprises an entrance portion, a raised portion, and a holding portion, the engaging structure is disposed around a periphery of the cover plate body, the engaging structure comprises an elastic raised portion, the elastic raised portion is raised toward an interior of the cover plate body, and when the engaging structure engages the locking slot structure, the elastic raised portion enters the locking slot structure through the entrance portion and slidably abuts against the raised portion while elastically deforming in a way for the elastic raised portion to be held by the holding portion.

* * * * *